US009963264B2

(12) United States Patent
Tang

(10) Patent No.: US 9,963,264 B2
(45) Date of Patent: May 8, 2018

(54) BASKET STRUCTURE

(71) Applicant: Pao-Hsun Tang, Changhua (TW)

(72) Inventor: Pao-Hsun Tang, Changhua (TW)

(73) Assignee: Malzine Co. Ltd., Changhua (TW)

( * ) Notice: Subject to any disclaimer, the term of this patent is extended or adjusted under 35 U.S.C. 154(b) by 0 days. days.

(21) Appl. No.: 14/552,846

(22) Filed: Nov. 25, 2014

(65) Prior Publication Data

US 2016/0144999 A1 May 26, 2016

(51) Int. Cl.
*B65D 6/34* (2006.01)
*B65D 6/08* (2006.01)
*A47B 88/40* (2017.01)

(52) U.S. Cl.
CPC ..... *B65D 7/14* (2013.01); *A47B 2088/401* (2017.01); *A47B 2210/04* (2013.01)

(58) Field of Classification Search
CPC ..... B65D 7/36; B65D 7/20; B65D 7/16
USPC ..... 220/485, 642, 656
See application file for complete search history.

(56) References Cited

U.S. PATENT DOCUMENTS 8,141,737 B1 * 3/2012 Tsai ..... B65D 7/14 220/485
2005/0077299 A1 * 4/2005 Cheng ..... A47B 55/02 220/485

* cited by examiner

*Primary Examiner* — Stephen Castellano
(74) *Attorney, Agent, or Firm* — Che-Yang Chen; Law Offices of Scott Warmuth

(57) ABSTRACT

A basket may include a main body and a side frame. The side frame surrounds at the portion of a connecting edge, and a first side and second side clamps with each other by applying a pressure on the side frame, so the first side clamps at an inner portion of the connecting edge and the second side clamps at an outer portion thereof. Thus, the side frame can be quickly connected with the main body without bending the connecting edge to a predetermined angle, which can simplify the assembly process and further reduce the production costs.

4 Claims, 5 Drawing Sheets

BASKET STRUCTURE

FIELD OF THE INVENTION

The present invention is related to a basket structure, and more particularly to an improved basket structure with simplified processing steps.

BACK GROUND OF THE INVENTION

As shown in FIG. 5, a conventional basket structure 40 may include a side board 41, both sides of which have connecting portions 42. A wing portion 43 is formed from one side of the connecting portion 42. A frame unit 50 has a receiving portion 51, and a first circular unit 52 and a second circular unit 53 are formed at both ends of the frame unit 50. The basket structure 40 and the frame unit 50 are assembled when the first circular unit 52 and second circular unit 53 are opened to wrap the wing portion 43. However, there are still some disadvantages in the conventional basket structure 40:

(1) When the conventional basket is processed, the wing portion 43 of the side board 41 has to be bent for a predetermined angle to connect with the frame unit 50. Thus, an additional processing step to bend the wing portion 43 is necessary. Since the basket 40 can be produced in mass production, the manufacturing costs can be significantly reduced if one of the steps can be eliminated.

(2) The first circular unit 52 and second circular unit 53 clamp the wing portion 43 of the basket 40. Since the first circular unit 52 and second circular unit 53 clamp the wing portion through the periphery thereof, the contact therebetween is merely linear, so the connecting strength is not strong enough due to insufficient contacting areas. Therefore, there remains a need for a new and improved basket structure to overcome the problems stated above.

SUMMARY OF THE INVENTION

To solve the problems stated above, the present invention provides a basket that may include a main body and side frame. The main body is a rhombic mesh structure having a connecting edge extending upwards at the periphery thereof. The main body has a bottom plate and a side board, and the side board forms a square with two openings, and the connecting edge is formed at a larger opening while a connecting portion is formed at a smaller opening. The side board is connected with the bottom plate with the connecting portion. The side frame has a first side and a second side, and the side frame surrounds the connecting edge of the main body, so the first side is located at an inner portion of the connecting edge and the second side is located at an outer portion thereof. Furthermore, applying pressure to the left and right sides of the side frame so that the first side and second side can directly clamp the connecting edge, namely to secure the first side and second side on the connecting edge with just one step. More specifically, the second side curledly clamps the connecting edge of the main body and forms an assisting portion to increase the strength of the basket structure.

In one embodiment, the basket has a rhombic mesh structure.

In another embodiment, the second side curledly clamps the connecting edge of the main body and forms an assisting portion to increase the strength of the basket structure.

In a further embodiment, the main body has a bottom plate and a side board, and the side board forms a square with two openings, and the connecting edge is formed at a larger opening while a connecting portion is formed at a smaller opening. The side board is connected with the bottom plate with the connecting portion.

The main objective of the present invention is that the side frame surrounds at the portion of the connecting edge, and the first side and second side clamps with each other by applying a pressure on the side frame, so the first side clamps at the inner portion of the connecting edge and the second side clamps at the outer portion thereof. Thus, the side frame can be quickly connected with the main body without bending the connecting edge to a predetermined angle, which can simplify the assembly process and further reduce the production costs.

The second objective of the present invention is that the first side of the side frame is pressed on the connecting edge of the main body with its inner surface, while the second side of the side frame curls inwardly, so the second side can clamp the connecting edge from outside to increase the contacting areas between the side frame and main body to further increase the structural strength.

The third objective of the present invention is that the side frame becomes a tubular unit to form the assisting portion at the lower portion of the side frame. When the main body is disposed at a guiding path of a rack, the assisting portion is used to reduce the contacting area with the guiding path to smoothly pull out the main body.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
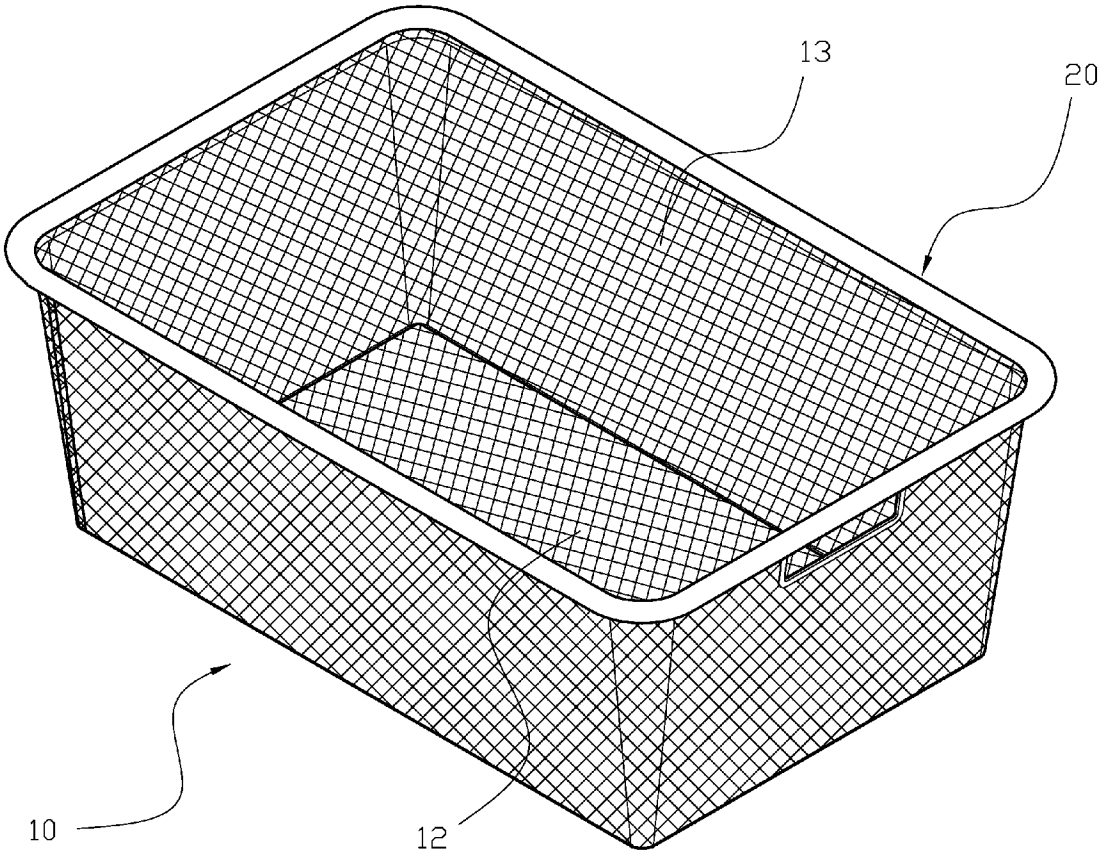
FIG. 1 illustrates a three-dimensional view of the basket in the present invention.
Figure 2:
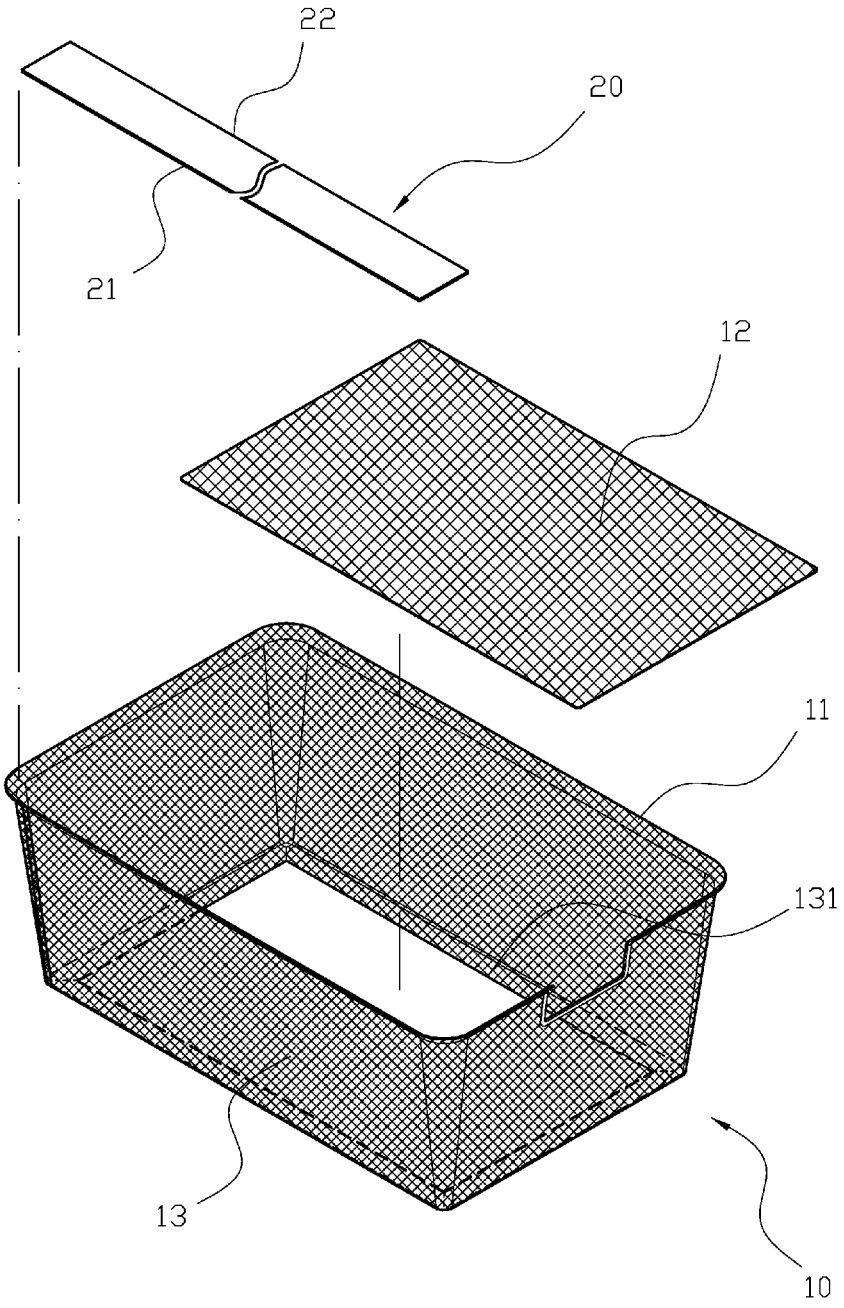
FIG. 2 illustrates an exploded view of the basket in the present invention.
Figure 3:
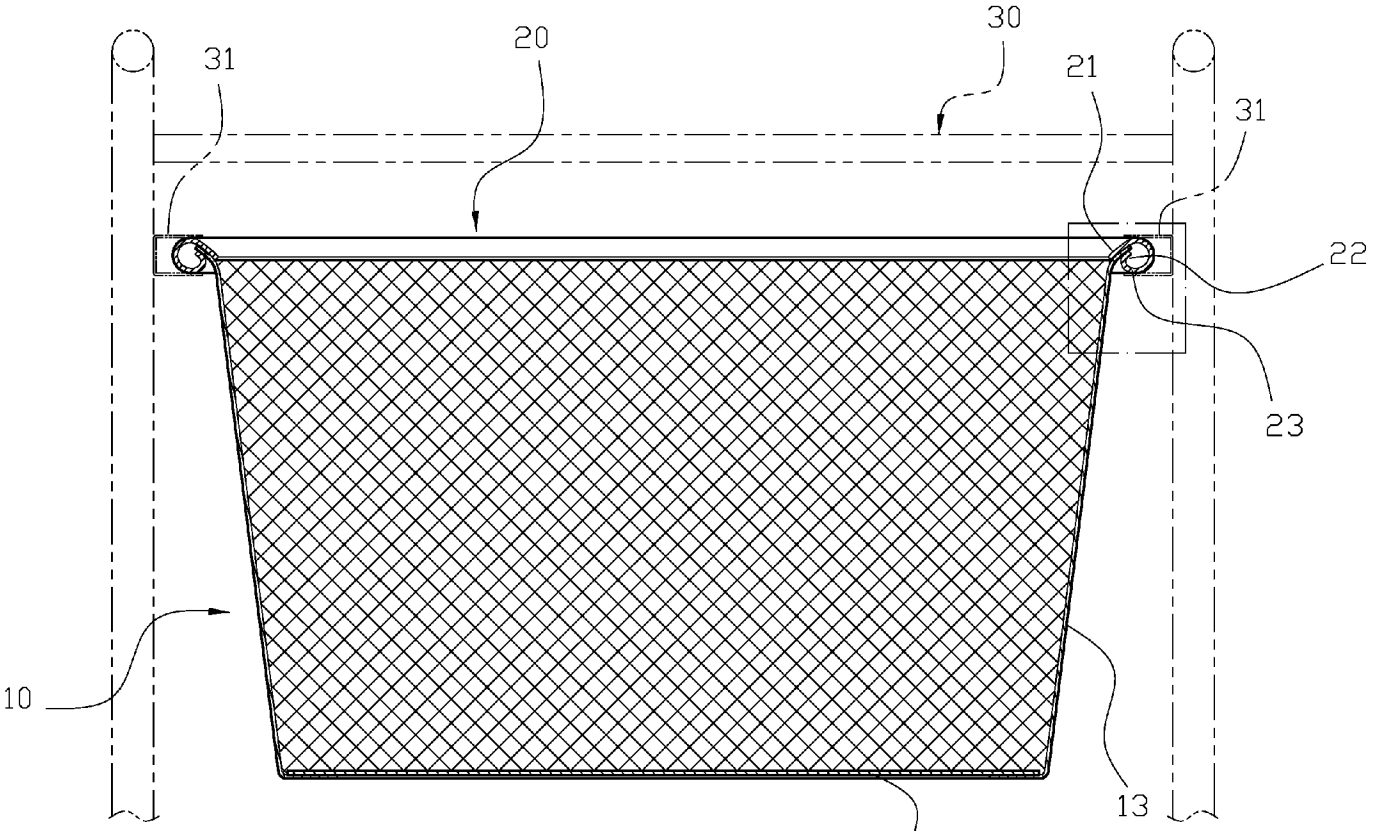
FIG. 3 illustrates a schematic view of the present invention when in use.
Figure 4:
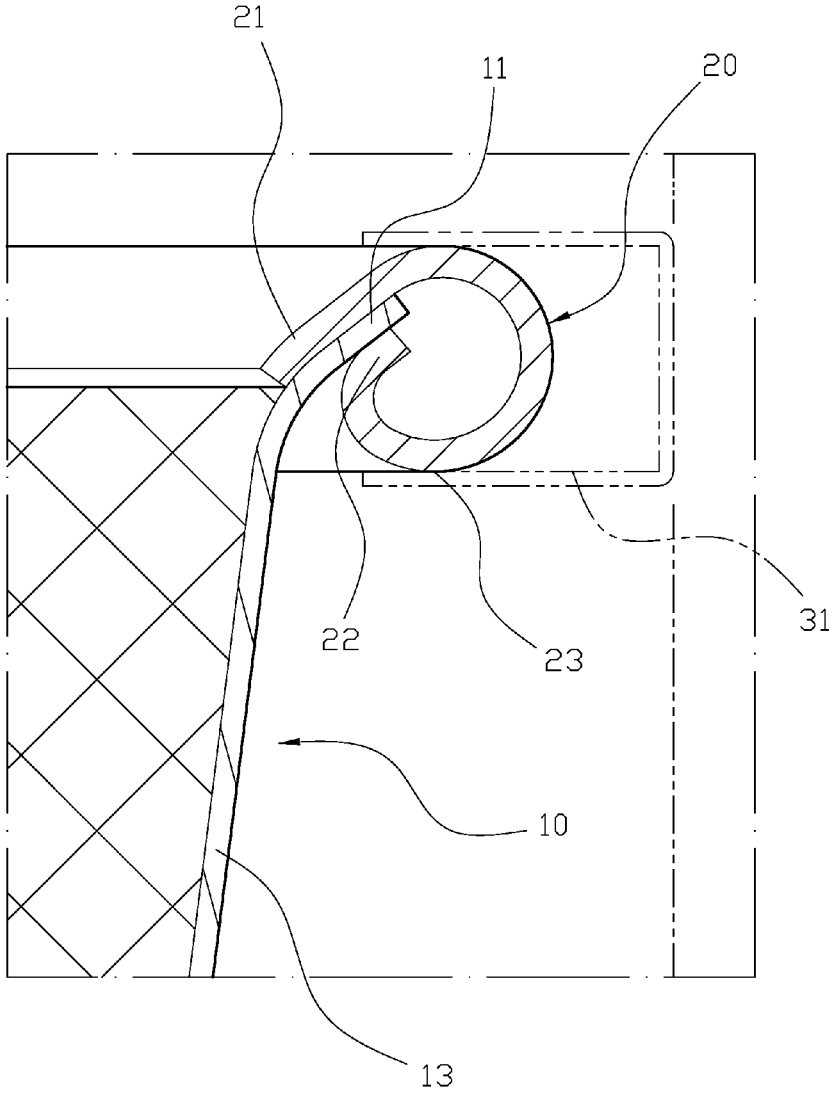
FIG. 4 illustrates a partial enlarged view of the side frame in FIG. 3.
Figure 5:
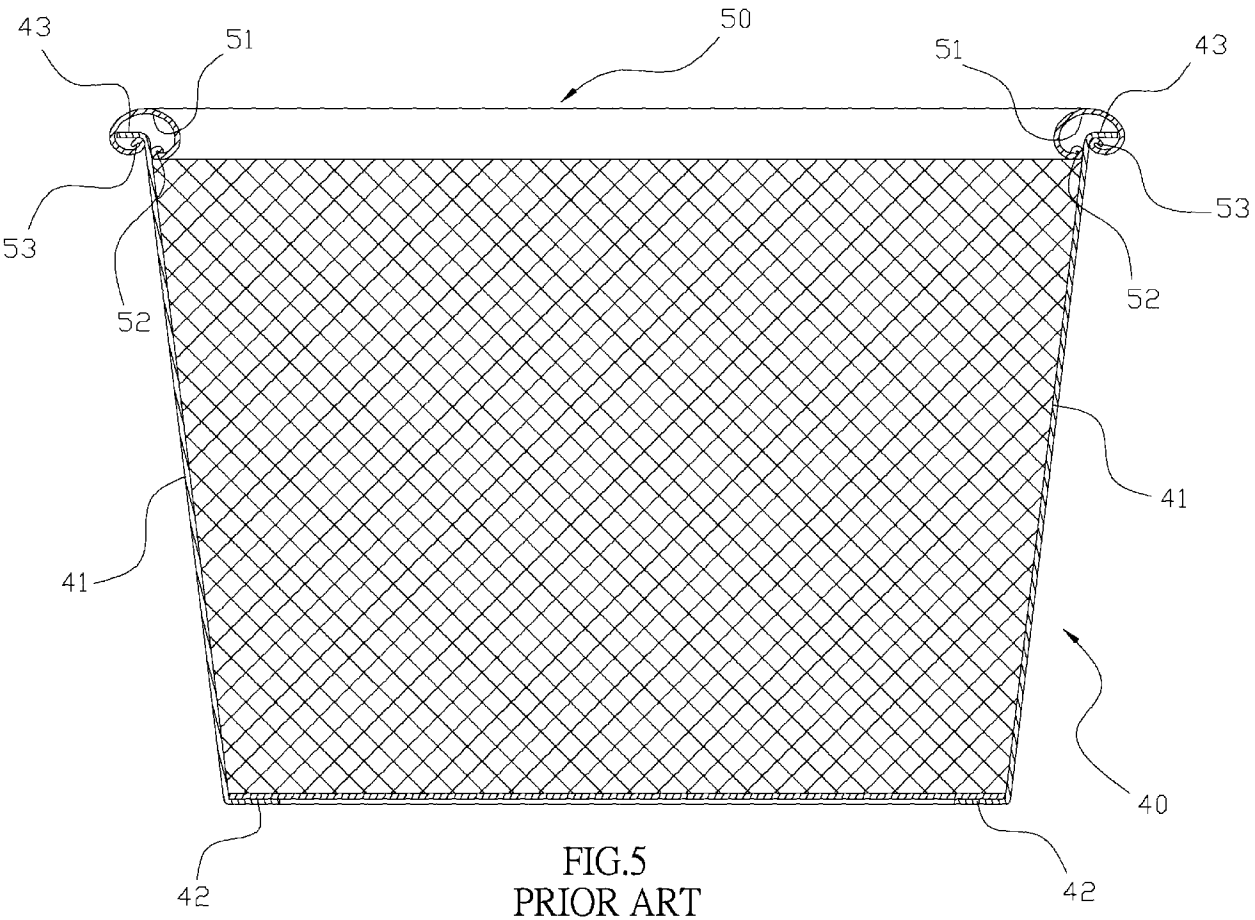
FIG.5 PRIOR ART
FIG. 5 illustrates a schematic view of a prior art.

In order to further understand the goal, characteristics and effect of the present invention, a number of embodiments along with the drawings are illustrated as following:

Referring to FIGS. 1 and 2, a basket may include a main body 10 and side frame 20. The main body 10 is a rhombic mesh structure having a connecting edge 11 extending upwards at the periphery thereof. The main body 10 has a bottom plate 12 and a side board 13, and the side board 13 forms a square with two openings, and the connecting edge 11 is formed at a larger opening while a connecting portion 131 is formed at a smaller opening. The side board 13 is connected with the bottom plate with the connecting portion 131. The side frame 20 has a first side 21 and a second side 22, and the side frame 20 surrounds the connecting edge 11 of the main body 10, so the first side 21 is located at an inner portion of the connecting edge 11 and the second side 22 is located at an outer portion thereof. Furthermore, applying pressure to the left and right sides of the side frame 20 so that the first side 21 and second side 22 can directly clamp the connecting edge 11, namely to secure the first side 21 and second side 22 on the connecting edge 11 with just one step. More specifically, the second side 22 curledly clamps the connecting edge 11 of the main body 10 and forms an assisting portion or curved portion 23 (see FIG. 4) to increase the strength of the basket structure.

As shown in FIGS. 1 to 4, when in use, the main body 10 has two square openings through the side board 13, and one opening forms the connecting edge 11, while the other opening forms the connecting portion 131. The connecting portion 131 is further used to connect to the periphery of the bottom plate 12 to form the structure of the main body 10. Furthermore, the side frame 20 surrounds at the portion of the connecting edge 11. The first side 21 has a first flat portion 21*a*. The second side 22 has a second flat portion 22*a*. The side frame 20 has an inner surface 24 and an outer surface 25. The first side 21 and the second side 22 clamps with each other by applying a pressure on the side frame 20, so the first side 21 clamps at the inner portion of the connecting edge 11 and the second side 22 clamps at the outer portion thereof. A portion of the inner surface 24 of the side frame 20 at the first side 21 attaches to an inner flat surface of the connecting edge 11 while a portion of the outer surface 25 of the side frame 20 at the second side 22 attaches to an outer flat surface of the connecting edge 11. Thus, the side frame 20 can be quickly connected with the main body 10 without bending the connecting edge 11 to a predetermined angle, which can simplify the assembly process and further reduce the production costs.

The first side 21 of the side frame 20 is pressed on the connecting edge 11 of the main body 10 with its inner surface, while the second side 22 of the side frame 20 curls inwardly, so the second side 22 can clamp the connecting edge 11 from outside to increase the contacting areas between the side frame 20 and main body 10 to further increase the structural strength. Meanwhile, the side frame 20 becomes a tubular unit to form the assisting portion 23 at the lower portion of the side frame 20. When the main body 10 is disposed at a guiding path 31 of a rack 30, the assisting portion 23 is used to reduce the contacting area with the guiding path 31 to smoothly pull out the main body 10.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A basket comprising:

a main body having a connecting edge extending upwards at a periphery thereof; and a side frame having a first side having a first flat portion and a second side having a curved portion integrally connected with a second flat portion, said side frame having an inner surface and an outer surface, and the side frame surrounding the connecting edge of the main body, so the first side disposed on an inner portion of the connecting edge and the second side disposed on an outer portion thereof; the first side and second side directly clamping the connecting edge when pressure applied to both sides of the side frame, wherein the first flat portion of the first side is integrally connected with the curved portion of the second side; the inner portion of the connecting edge has an inner flat surface while the outer portion thereof has an outer flat surface; and a portion of the inner surface of the side frame at the first side attaches to the inner flat surface of the connecting edge while a portion of the outer surface of the side frame at the second side attaches to the outer flat surface thereof when the connecting edge is clamped, and a radius of curvature of the curved portion of the side frame is greater than a thickness of the connecting edge of the main body.

2. The basket of claim 1, wherein the second side curledly clamps the connecting edge of the main body and forms an assisting portion to increase the strength of the basket structure.

3. The basket of claim 1, wherein the main body has a bottom plate and a side board, and the side board forms a square with two openings, and the connecting edge is formed at a larger opening while a connecting portion is formed at a smaller opening, and the side board is connected with the bottom plate with the connecting portion.

4. The basket of claim 1, wherein the main body is a rhombic mesh structure.

* * * * *